US010850378B2

(12) United States Patent
Cordeiro et al.

(10) Patent No.: US 10,850,378 B2
(45) Date of Patent: Dec. 1, 2020

(54) FUEL CARTRIDGE FOR A GAS-POWERED FIXING TOOL AND A GAS-POWERED FIXING TOOL HAVING SUCH A CARTRIDGE

(71) Applicant: Illinois Tool Works Inc., Glenview, IL (US)

(72) Inventors: Pierre Cordeiro, Livron sur Drome (FR); Patrick Herelier, Saint Jean de Muzols (FR); Frederic Nayrac, Bourg les Valence (FR); Alain Vettoretti, Bourg les Valence (FR)

(73) Assignee: Illinois Tool Works Inc., Glenview, IL (US)

( * ) Notice: Subject to any disclaimer, the term of this patent is extended or adjusted under 35 U.S.C. 154(b) by 500 days.

(21) Appl. No.: 15/378,890

(22) Filed: Dec. 14, 2016

(65) Prior Publication Data

US 2017/0173772 A1 Jun. 22, 2017

(30) Foreign Application Priority Data

Dec. 18, 2015 (FR) ..... 15 62720

(51) Int. Cl.
*B25C 1/08* (2006.01)
*B25C 1/10* (2006.01)
*B25C 1/16* (2006.01)

(52) U.S. Cl.
CPC ..... *B25C 1/08* (2013.01); *B25C 1/105* (2013.01); *B25C 1/163* (2013.01)

(58) Field of Classification Search
CPC . B25C 1/08; B25C 1/105; B25C 1/163; F16B 7/20; F16L 37/12; F16L 37/24; B05B 11/0054

(Continued)

(56) References Cited

U.S. PATENT DOCUMENTS 2,129,704 A * 9/1938 Meyer ..... F16L 37/22 251/149.6
3,890,731 A 6/1975 Aldrin (Continued)

FOREIGN PATENT DOCUMENTS

FR 1 096 723 6/1955
FR 1 526 227 5/1968

(Continued)

OTHER PUBLICATIONS

Australian Examination Report No. 1 for Australian Application No. 2016266088, dated Nov. 3, 2017 (3 pages).

*Primary Examiner* — Thanh K Truong
*Assistant Examiner* — Patrick B Fry
(74) *Attorney, Agent, or Firm* — Neal, Gerber & Eisenberg LLP

(57) ABSTRACT

Various embodiments of the present disclosure provide a fuel cartridge for a gas-powered fastener-driving tool. In one embodiment, the fuel cartridge comprises a body that has a longitudinal axis and that defines an internal fuel storage cavity. The body is shaped and sized to be inserted at least partially into and removed from a housing defined by a case of the tool via translation along the longitudinal axis. The cartridge also includes a connection and fuel dispensing end fitting connected to the body and sized and shaped to engage an end fitting of the tool within the housing. The cartridge also includes a first cam surface extending at least partially around the longitudinal axis and configured to, during relative rotation of the first cam surface and a second cam surface, engage the second cam surface to facilitate removal of the fuel cartridge from the housing.

19 Claims, 8 Drawing Sheets

(58) Field of Classification Search
USPC ..... 285/362, 377; 137/614.03, 614.04
See application file for complete search history.

(56) References Cited

U.S. PATENT DOCUMENTS 5,184,851 A * 2/1993 Sparling ..... F16L 37/252 285/314
5,333,915 A * 8/1994 Sparling ..... F16L 37/252 285/69
5,752,643 A * 5/1998 MacVicar ..... B25C 1/008 227/10
6,015,171 A * 1/2000 Schorn ..... F16L 37/12 251/148
6,123,241 A * 9/2000 Walter ..... B25C 1/08 123/46 SC
7,922,214 B2 * 4/2011 Nakamura ..... F16L 37/084 285/307
8,424,939 B2 * 4/2013 Slack ..... E21B 19/07 294/86.25
8,490,650 B2 * 7/2013 Yoshihiro ..... F16L 37/23 137/614.03
8,857,398 B2 * 10/2014 Schieszl ..... F16L 37/113 123/184.21
8,967,209 B2 * 3/2015 Ho ..... B65D 39/00 141/346
2007/0107720 A1 * 5/2007 Boeck ..... B05B 11/0054 128/200.21
2007/0119897 A1 * 5/2007 Boenig ..... B25C 1/08 227/10
2010/0068586 A1 * 3/2010 Takahashi ..... H01M 8/04201 429/492
2014/0069981 A1 * 3/2014 Ricordi ..... B25C 1/008 227/8
2015/0354742 A1 * 12/2015 Holtby ..... F16L 21/08 285/308

FOREIGN PATENT DOCUMENTS

FR 2213476 8/1974
GB 946 814 1/1964

* cited by examiner

FUEL CARTRIDGE FOR A GAS-POWERED FIXING TOOL AND A GAS-POWERED FIXING TOOL HAVING SUCH A CARTRIDGE

PRIORITY CLAIM

This patent application claims priority to and the benefit of French Patent Application No. 1562720, which was filed on Dec. 18, 2015, the entire contents of which are incorporated herein by reference.

TECHNICAL FIELD

The present disclosure relates to a fuel cartridge for a gas-powered fixing tool and a gas-powered fixing tool having such a cartridge.

BACKGROUND

The so-called gas-powered fastening or fixing tools are tools having an internal combustion engine operated by the firing of a fuel-air mixture in a combustion chamber, the fuel being injected into the chamber by an injection device from a fuel cartridge. Such tools are intended to drive fastening elements into support materials in order to secure parts. Gas-powered nailers are now very common. As fuel for an internal combustion engine, examples include petrol, alcohol, in liquid and/or gas form.

Generally speaking, such a tool is portable and comprises a case in which is mounted the internal combustion engine that powers a drive piston of a fastening element. Such a tool may also include a battery power supply and a gripping, handling and firing handle on which a triggering mechanism of the tool is mounted.

A firing cycle comprises several steps such as the distribution of a quantity of fuel by the cartridge, admission of fuel into the chamber, mixing the fuel with the air in the chamber, ignition and combustion of the mixture to drive the piston, and discharge of combustion gases from the chamber.

A fuel cartridge conventionally comprises a body comprising an internal fuel storage cavity, and a connection and fuel dispensing end fitting configured to cooperate by interlocking with the abovementioned injection device.

The body is generally configured to be at least partly engaged in a housing of the tool and to be disengaged by translation along a longitudinal axis of the body.

The present disclosure proposes to improve this technology.

SUMMARY

The present disclosure proposes a fuel cartridge for a gas-powered fixing tool, comprising a body comprising an internal fuel storage cavity, the body being configured to be engaged at least partly in a housing of the tool and to be disengaged therefrom, by translation along a longitudinal axis of the body, the cartridge comprising, among other things, a connection and fuel dispensing end fitting configured to cooperate with a complementary means of the tool upon the abovementioned engagement of the body, characterized in that the cartridge comprises means for facilitating its disengagement from the housing, the means comprising at least one first cam surface which extends at least partly around the axis.

The present disclosure thus proposes to facilitate the removal of the cartridge by first means, namely at least a first cam surface, provided on the cartridge. This or each cam surface extends at least partially around the longitudinal axis of body of the cartridge, i.e. that its slope is at least partially oriented around this axis. In certain embodiments, the intersection between a first plane containing the cam surface and by a second plane perpendicular to the aforementioned longitudinal axis and passing through this cam surface, substantially forms a radius of this longitudinal axis.

The cartridge of the present disclosure may comprise one or more of the following characteristics, taken separately from each other or in combination with each other:

- the at least one cam surface is situated on a crown ring mounted to the cartridge and extending at least partially around the end fitting;
- the crown ring comprises two or three cam surfaces regularly distributed around the axis and oriented in the same direction around this axis;
- the cam surfaces are situated on a first circumference centered on the axis;
- the crown ring comprises at least one hook, and in certain embodiments two or three hooks evenly distributed around the axis, configured to cooperate with a complementary means of the tool;
- the hook or the hooks are situated on a second circumference centered on the axis, different from the first circumference;
- the crown ring comprises a peripheral edge having an indexing flat or having a radially outer indexing tongue;
- the crown ring is formed of a single piece, for example in plastic material, and is mounted, for example force fitted, on the body.

The present disclosure further relates to a gas-powered fixing tool, having a case with a housing configured to receive a fuel cartridge as described above, the tool further comprising at least one second cam surface configured to cooperate with the first cam surface and extending at least partially around a longitudinal axis of the housing.

The tool according to the present disclosure may comprise one or more of the following characteristics, taken separately from each other or in combination with each other:

- the tool comprises a ring bearing the at least one second cam surface and rotationally mobile around the axis;
- the ring is mounted rotationally mobile with respect to a fuel injection member, the member having a complementary means of the end fitting of the cartridge;
- the ring is mounted rotationally mobile with respect to the case and comprises a radially outer finger passing through an opening of the case, a free end of the finger being configured to be situated outside the case and accessible by a user in order to disengage the cartridge by rotating the ring in the opening;
- the ring comprises two or three second cam surfaces regularly distributed around the axis and oriented in the same direction around this axis;
- the second cam surfaces are situated on a first circumference centered on the axis;
- the ring comprises at least one hook, and in certain embodiments two or three hooks evenly distributed around the axis, configured to cooperate with a complementary means of the cartridge;
- the hook or the hooks are situated on a second circumference centered on the axis, different from the first circumference, the case comprises, within the housing, indexing and/or guide means configured to cooperate with a complementary means of the cartridge, and the ring is formed of a single piece, for example in plastic material.

BRIEF DESCRIPTION OF THE FIGURES

The present disclosure will be better understood and other details, characteristics and advantages of the present disclosure will become more apparent in light of the following description, given by way of non-limiting example and in reference to the accompanying drawings.

DETAILED DESCRIPTION

In the description that follows, the terms front, rear, lower, upper, axial, radial, etc., refer to the position of an element relative to an axis and/or in relation to the normal conditions of use of the tool.

The fixing tool 10 is partially represented in the Figures. This tool comprises a case 12 in which is located an internal combustion engine with a combustion chamber (or a pre-combustion chamber and a combustion chamber) intended to contain a mixture of air and of fuel, the ignition of which triggers the propulsion of a piston provided to drive a fastening element extracted from a feed magazine, the fastening element intended to be anchored in a support material, at the outlet of a nail guide extending at the front of the case. All these components of gas-powered tools are well known to those skilled in the art and thus have not all been represented in the Figures.

Figure 1:
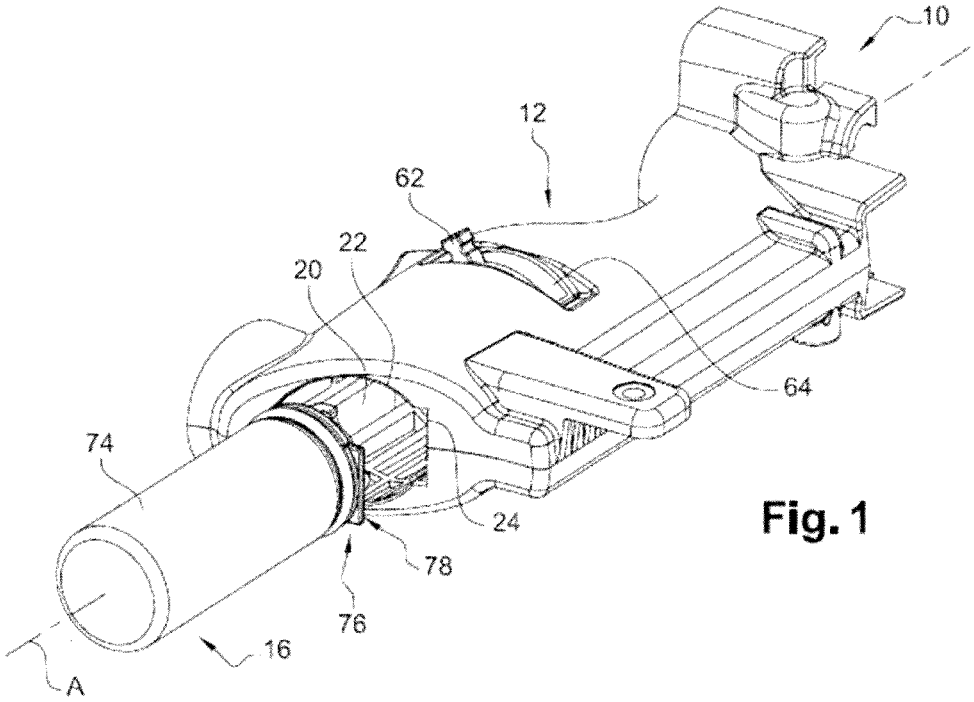
FIG. 1 is a schematic perspective view of a portion of a gas-powered fixing tool and illustrates a step of inserting or removing a fuel cartridge into a housing of the tool.
Figure 2:
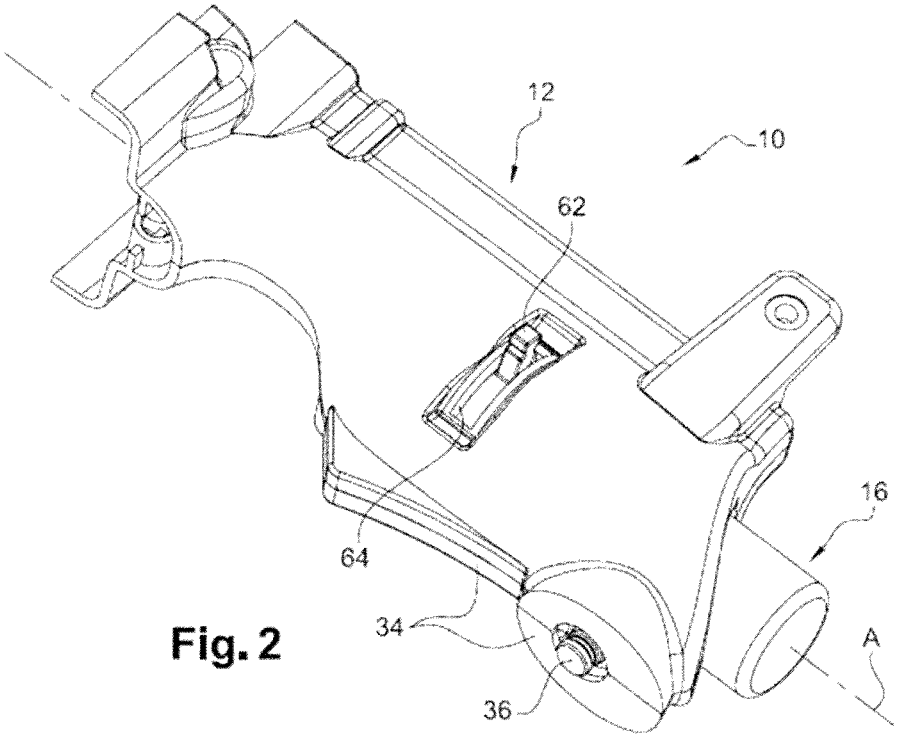
FIG. 2 is another schematic perspective view of the tool part of FIG. 1, the fuel cartridge being inserted into the housing of the tool.
Figure 3:
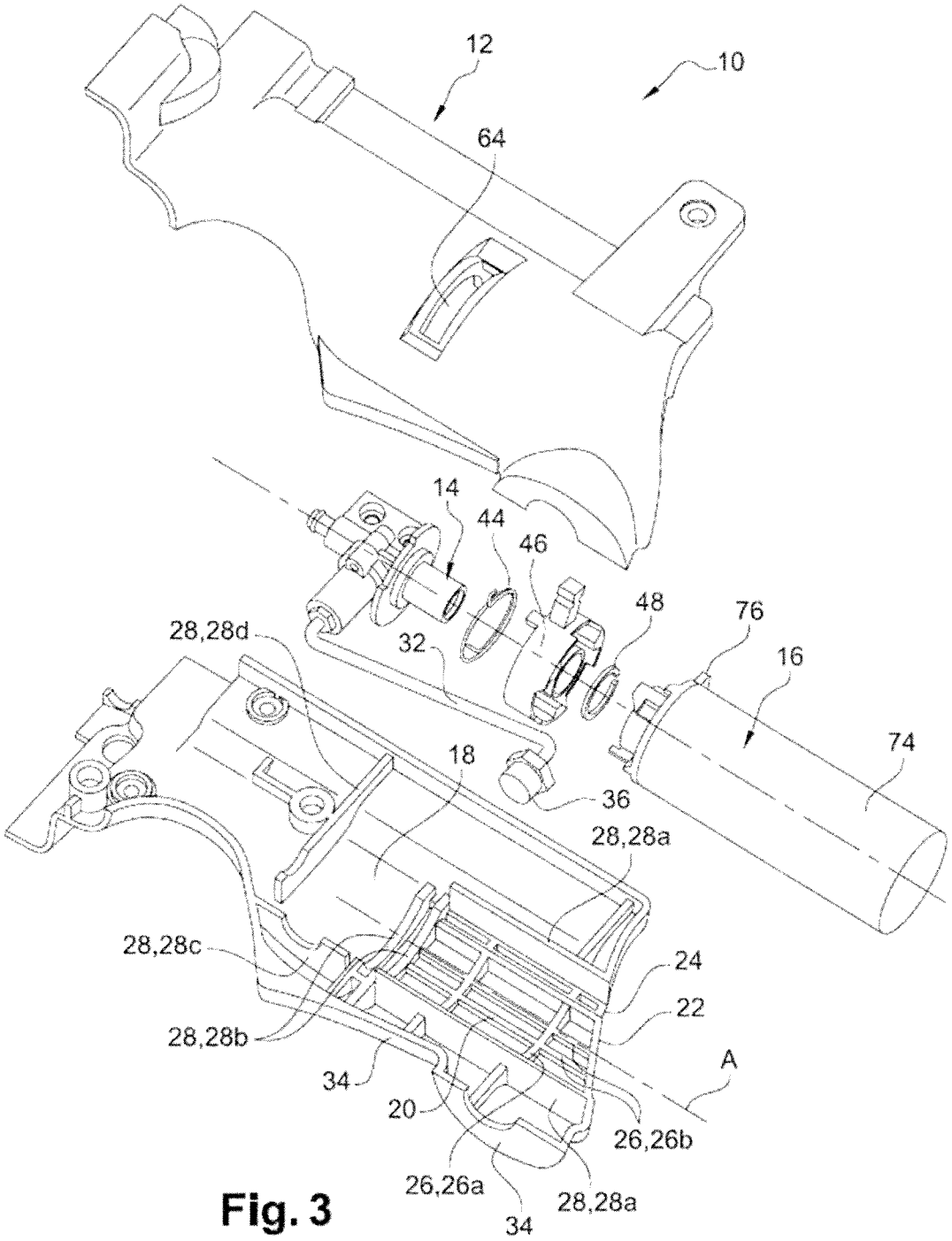
FIG. 3 is a schematic exploded perspective view of the tool part of FIG. 1.

The combustion chamber of the engine is supplied with fuel by means of an injection member 14, from a gas fuel cartridge 16 (FIGS. 1 to 3).

The case 12 of the tool comprises a handle for gripping and handling the tool. The handle is also used for firing, by a triggering mechanism mounted on it. The part of the case 12 represented in the Figures can extend substantially parallel to the handle of the tool, and downstream thereof when the tool is being used.

In the example shown, the part represented of the case 12 comprises two half-shells that are secured together by screws, for example. Between them, the two half-shells define a first housing 18 for receiving the injection device 14 and a second housing 20 for receiving the cartridge 16 and more exactly a portion thereof.

The visible part of the case 12 has an elongated shape and the housings 18, 20 are arranged one behind the other along the longitudinal axis of the case. The housing 18 is located substantially in the middle of the case 12 and the housing 20 extends between the housing 18 and a longitudinal end of the case 12.

The housing 20 has an elongated shape of axis A and comprises a longitudinal end that communicates with the housing 18 and an opposite longitudinal end that opens on the aforementioned longitudinal end of the case, to form an assembly/disassembly opening 22 of the cartridge in the housing 20.

As can be better seen in FIG. 1, the opening 22 has a general circular or ovoid shape and has a notch 24, substantially oriented radially relative to the axis A. This notch 24 has a general rectangular shape.

On its inner surface, each half-shell comprises stiffeners 26 and inner walls 28 (FIG. 3).

The housing 20 is bounded by lateral internal walls 28*a* substantially parallel to the axis A and by two upper inner walls 28*b* substantially perpendicular to the axis A. First stiffeners 26*a* extend between the walls 28*a*, substantially perpendicular to the axis A, and second stiffeners 26*b* extend between the walls 28*a*, substantially parallel to the axis A. The stiffeners 26*a*, 26*b* are shaped to extend in the housing 20 in the continuity of the cross-sectional area defined by the opening 22. The cross-sectional area thus defined by the stiffeners 26*a*, 26*b* of the half-shells is substantially identical to that defined by the opening 22. It is therefore clear that the stiffeners 26*b* extend in continuation of the lateral edges of the notch 24. One of the walls 28*a* extends in continuation of the front edge of the notch. The stiffeners 26*b* or the walls 28*a* form the means for guiding the cartridge during its assembly/disassembly, as will be described in more detail in what follows.

The walls 28*b* are parallel and spaced apart from each other.

The housing 18 is bounded by internal walls in the example shown, including the walls 28*b*, a rear wall 28*c* substantially parallel to the axis A and an upper wall 28*d* substantially perpendicular to the axis A. The walls 28*b*, 28*c* and 28*d* of the half-shells comprise mounting holes in parts of the injection device 14 and of the cartridge 16.

The injection device 14 comprises an end fitting 30, here of the female type, connecting with a male type end fitting on the cartridge 16, which is not visible in the Figures.

The end fitting 30 is housed with other elements of the device 14 in the housing 18 and is connected to a supply line 32 from the combustion chamber of the tool. This line 32 has a general S-shape and comprises a straight elongated portion that is housed between the rear walls 28*a* and external walls 34 of the half-shells. The end of the line 32, opposite the end fitting 30, is connected to a connecting member 36 to the combustion chamber. This member 36 is mounted in an orifice of the outer walls 34 of the case. The aforementioned elements of the device 14 are also mounted and wedged in the aforementioned orifices of the walls 28*c* and 28*d*.

Figure 4:
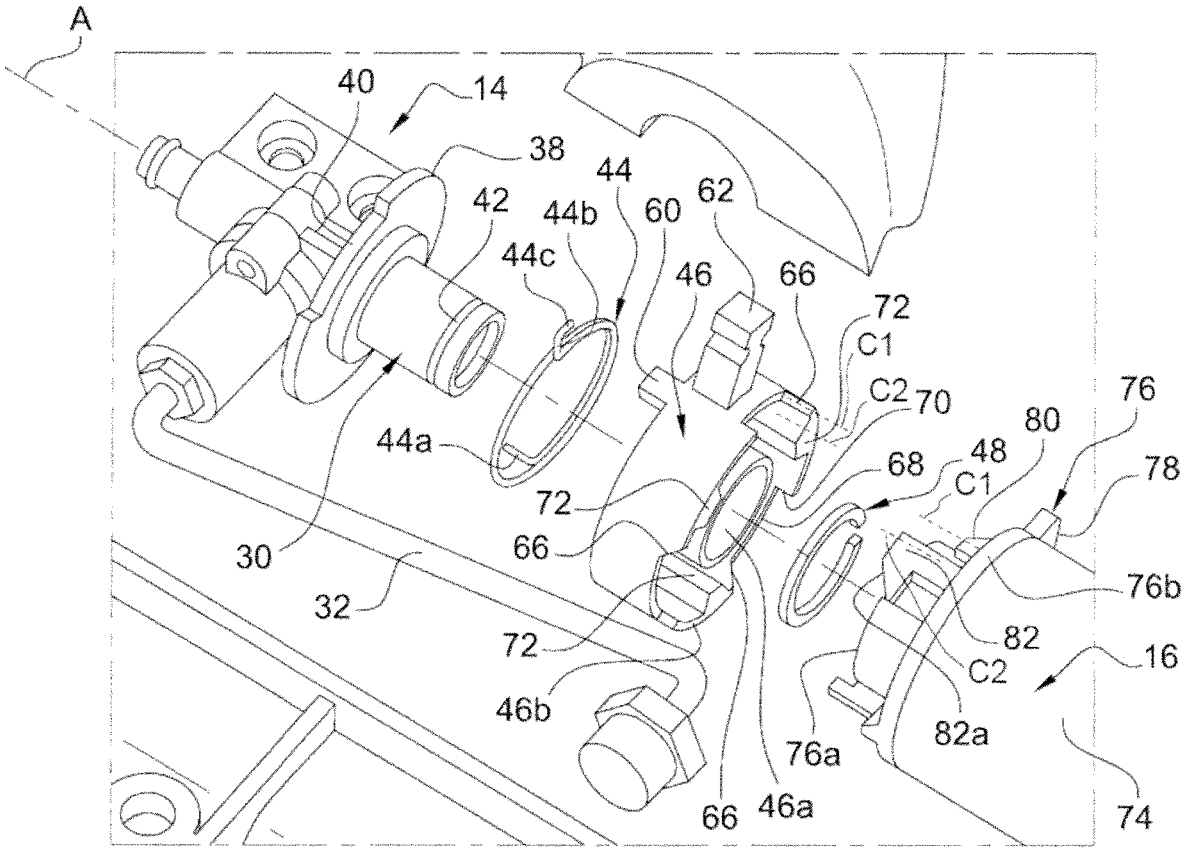
FIG. 4 is a view in a larger scale of a part of FIG. 3.

The end fitting 30, more visible in FIG. 4, comprises a cylindrical body having an inner bore for engaging the end fitting of the cartridge 16. The lower end of the body of the end fitting, located on the side of the housing 20, is free to cooperate with the cartridge, and its opposite end is connected to an outer annular flange 38.

On its outer periphery, the flange 38 comprises a notch 40 that extends over an angular sector of predetermined angle around the axis A. The aforementioned free end of the body of the end fitting comprises an external annular groove 42.

As shown in FIG. 4, three parts are mounted on the end fitting 30 of the injection device 14 and are also intended to be received in the housing 18. These parts include a spring 44, a ring 46 and a ring 48 that are coaxial and therefore aligned with the axis A.

The spring 44 comprises at least one metal coil that surrounds the body of the end fitting and is mounted between the flange 38 and the ring 46. The spring 44 comprises one end bearing on the flange 38 in the circumferential direction and a second end bearing circumferentially on the ring 46. The first end of the spring 44 here comprises an axial finger 44*a* passing through an orifice of the flange 38 and its second end comprises a radial finger 44*b* cooperating with the ring 46. This radial finger 44*b* can have its outer radial end 44*c* bent in the circumferential direction, so as be substantially L-shaped (FIG. 4).

The ring 46 is here formed of a single piece, for example in plastic material. It surrounds the body of the end fitting 30 and is held axially on the latter by means of the ring 48, which is a split lock ring intended to be mounted in the groove 42 of body of the end fitting 30.

The ring 46 is mounted rotationally mobile on the body of the end fitting 30, around the axis A. It is guided in rotation by the two walls 28*b* of the case.

In the example shown, the ring 46 comprises two cylindrical walls, internal 46*a* and external 46*b*, respectively, extending one around the other.

The inner wall 46*a* is slidably mounted on the body of the end fitting 30. The upper peripheral edge of the outer wall 46*b*, located on the opposite side of the housing 20, comprises a tongue 60 projecting parallel to the axis A. This tongue 60 is intended to be engaged in the notch 40 of the flange 38 and to cooperate by abutment with the circumferential ends of this notch 40 to the angular travel of the ring 46 with respect to of the end fitting 30 around the axis A. The radial finger 44*b* of the spring 44 bears circumferentially on this tongue 60 to solicit it in the circumferential direction toward a circumferential end of the notch 40. The bent end of the finger 44 can extend around the tongue 60 and may be used to pinch the tongue and thus ensure an attachment of these two elements. The spring 44 can be mounted preloaded circumferentially between the end fitting 30 and the ring 48.

The outer wall 46*b* of the ring 46 further comprises a finger 62 extending radially outwardly relative to the axis A. This finger 62 is intended to pass through an opening 64 of one of the half-shells of the case 12 (FIGS. 1 and 2). The outer radial end of the finger 62 is free and intended to be accessible by a user to be moved in the opening 64, which has an elongated shape and extends around the axis A. The opening 64 extends over an angular sector of angle substantially equivalent to that of the notch 40.

It is therefore clear that the movement of the finger 62 in the opening will drive the ring 46 in a rotational movement about the end fitting 30, and the tongue 60 in the notch 40. The ring 46 is movable from a first position, wherein the tongue 60 and the finger 62 are located in the first circumferential ends of the notch 40 and the opening 64 (FIG. 5*a*), respectfully, to a second position wherein the tongue 60 and the finger 62 are located in second circumferential ends opposite the notch 40 and the opening 64 (FIG. 5*d*), respectively. The first position is a rest position wherein the spring 44 holds the tongue 60 in the aforementioned position, and the second position is a position imposed by the user by applying a force on the finger 62, to overcome the return force of the spring.

The lower peripheral edge of the outer wall 46*b*, located on the side of housing 20, comprises arrangements or recesses defining cam surfaces 66, three in this case. The cam surfaces 66 are regularly distributed around the axis A. They are at least partly oriented around the axis A. In other words, the intersection between a first plane containing the cam surface and a second plane perpendicular to the axis A and passing through this cam surface, substantially forms a radius of the axis A.

In the example shown, each cam surface 66 has a longitudinal dimension or height along the axis, which represents 10 to 50% of that of the outer wall 46*b* or the ring 46. Its circumferential dimension or length around the axis extends over an angular sector between approximately 2 and 10°.

Each cam surface 66 is connected at one end to the lower peripheral edge of the wall 46*b*, and at an opposite end to one end of a circumferential end 68 whose opposite end is connected to an axial connecting edge 70 to the lower peripheral edge of the wall 46*b*. The angular sector extending between the axial edge 70 and the end of the cam surface 66, opposite this axial edge, has an angle that is less than that of the notch 40 and of the opening 64.

Between its walls 46*a*, 46*b*, the ring 46 comprises hooks 72 oriented circumferentially with respect to the axis A. The hooks 72 are uniformly distributed about the axis A. It is understood that the hooks 72 are located on a circumference C2 different from the circumference C1 passing through the cam surfaces 66, C2 having a radius smaller than C1.

The fuel cartridge 16 will now be described.

The cartridge 16 comprises a body 74, substantially cylindrical here, comprising an internal fuel storage cavity, and the aforementioned end full connection and distribution end fitting, that is configured to cooperate by interlocking with the end fitting 30 of the device 14 and that is not visible in the Figures.

The body 74 is configured to be engaged, here in part, in the housing 20 of the case 12 and to be disengaged, by translation along the axis A, which is the longitudinal axis of the body when the cartridge is aligned on the axis A, as shown in FIG. 1.

The cartridge 16 further bears a crown ring 76 around its connection end fitting. Here, this crown ring 76 is formed of a single piece, for example in plastic material, and can be force fitted on the body 74. The cartridge 16 equipped with the crown ring 76 can represent a consumable of the tool 10.

The crown ring 76 comprises a cylindrical wall 76*a* of axis A and a radial annular wall 76*b* that here bears axially on an outer peripheral edge of the upper end of the body 74 of the cartridge (FIG. 4).

The radial wall 76*b* comprises a flat section or a tongue 78 projecting radially, which is substantially complementary to the notch 24 of the opening 22 of the case. The tongue 78 and notch 24 form indexing means to ensure proper angular positioning of the cartridge 16 about the axis A when inserted into the housing 20. It is understood that this tongue 78 is intended to cooperate with the stiffeners 26*b* and the front side wall 28*a* of the case in order to guide the translation of the cartridge along the axis A in the housing 20.

The cylindrical wall 76*a* is intended to cooperate by axial sliding and circumferential with the inner wall 46*b* of the ring. It is intended to extend around the wall 46*b*, between it and the hooks of the ring 46.

The crown ring 76 comprises projecting studs on the upper surface of its wall 76*b*, that define cam surfaces 80, three in this case. The cam surfaces 80 are regularly distributed around the axis A. They are at least partly oriented around the axis A. In other words, the intersection between a first plane containing the cam surface and a second plane perpendicular to the axis A and passing through this cam surface, substantially forms a radius of the axis A.

In the example shown, each cam surface 80 has a longitudinal dimension or height substantially identical to that of the cam surfaces 66. Its circumferential dimension or length around the axis is substantially identical to that of the cam surfaces 66.

Between the wall 76*a* and the cam surfaces 80, the crown ring 76 comprises hooks 82 oriented circumferentially with respect to the axis A. The hooks 82 are uniformly distributed around the axis A and are intended to cooperate with the hooks 72 of the ring 46. It is understood that the hooks 82 are located on a circumference C2 different from the circumference C1 passing through the cam surfaces 80, C2 having a radius smaller than C1. Each hook 82 here has a general L-shape and comprises an axial portion connected to a circumferential portion. This circumferential portion comprises an upper cam surface 82*a* intended to cooperate with a lower cam surface of a hook 72, which may also have a general L-shape.

The cartridge 16 can be mounted or inserted in the housing 20 in the following manner.

The cartridge 16 is presented at the entrance of housing 20, i.e. opposite the opening 22, and aligned on the axis A as shown in FIG. 1, its upper end having the connection end fitting and the crown ring 76 intended to be inserted first into the housing 20.

The indexing tongue 78 cooperates with the notch 24 in order to correctly position the cartridge 16 with respect to the entrance of the housing 20.

The cartridge 16 is moved in translation along the axis A until its end fitting fits into the end fitting 30 of the injection device 14. In this nested position, a lower end part of the cartridge 16 remains outside the case as shown in FIG. 2, to facilitate its removal for replacement, for example.

When the end pieces are engaged, the cam surfaces of the hooks 72, 82 cooperate together so that the insertion force applied by a user on the cartridge generates a rotation of the ring 46 around the axis A. During this rotation, the studs of the crown ring 76 move into the emplacements of the ring 46 and pass, for example, from the position shown in FIG. 5*a* to the position shown in FIG. 5*b*. After the sliding of the cam surfaces of the hooks 72, 82 on one another, maintaining the insertion force on the cartridge enables the circumferential parts of the hooks 82 of the crown ring to extend axially past those of the hooks 72 of the ring 46. The spring 44 then ensures an elastic return of the ring 46 to its rest position, which ensures the engagement of the hooks 72 of the ring in those 82 of the crown ring. During this elastic return, the studs of the crown ring 76 move into the emplacements of the ring 46 and pass, for example, from the position shown in FIG. 5*b* to the position shown in FIG. 5*a*. The cartridge 16 is then locked and the tool 10 can be used.

The cartridge 16 can be removed or disengaged from the housing 20 in the following manner.

The user applies a force on the finger 62 to move it from its rest position shown in FIG. 2 to its opposite position shown in FIG. 1. The rotation of the finger 62 is carried out in several sub-steps that are illustrated by FIGS. 5*a* to 5*e*.

Figure 5A:
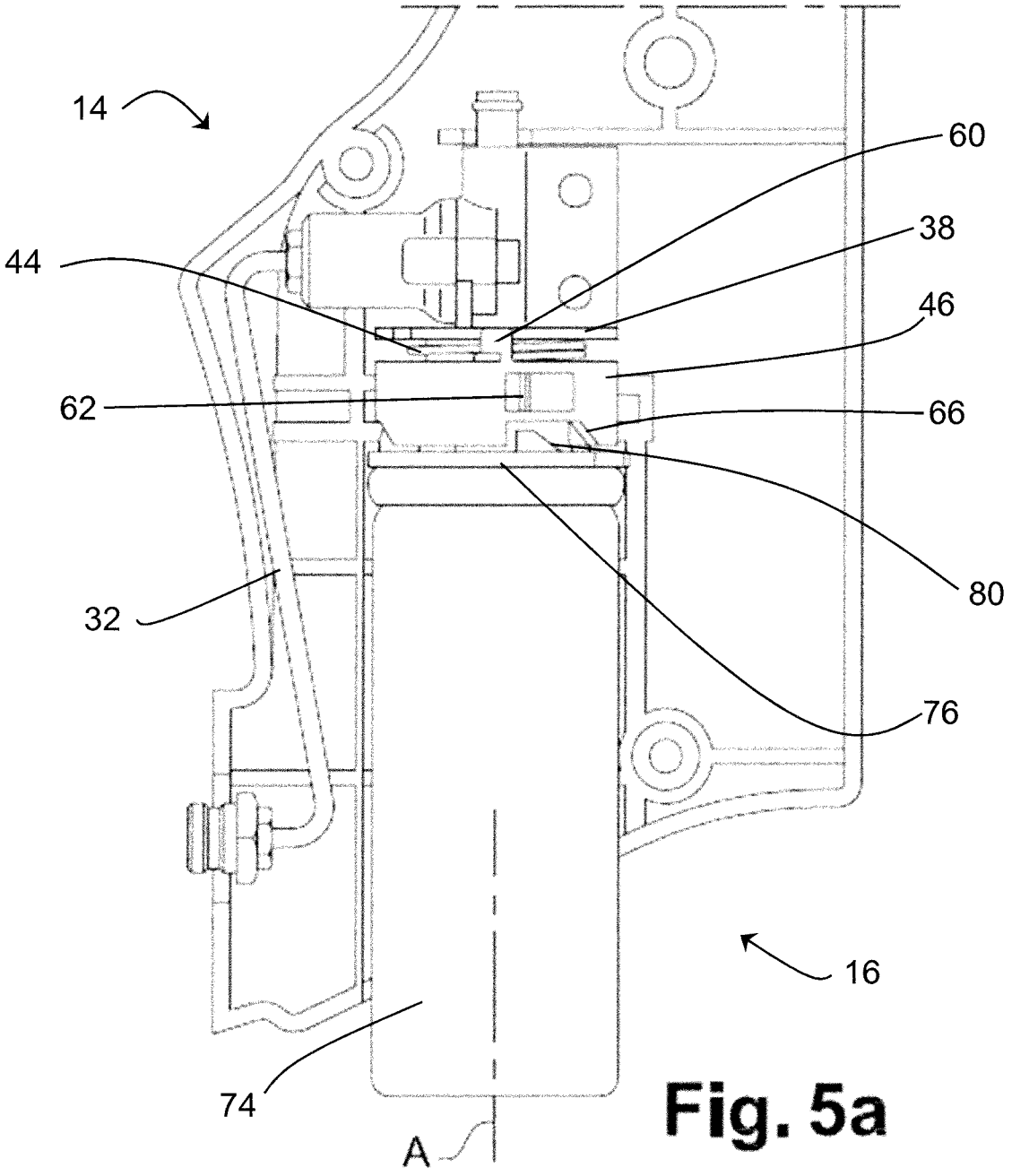
FIGS. 5*a* to 5*e* are schematic perspective views of the tool part of FIG. 1, with partial cutaway of a case of the tool, and illustrate steps for disengaging the fuel cartridge from the housing of this case.

FIG. 5*a*, with FIG. 2, represent the cartridge 16 and the ring 46 in the operating position. In this position, the studs of the crown ring 76 are located in the emplacements of the ring 46 and are at a circumferential distance from the cam surfaces of the ring 46.

Figure 5B:
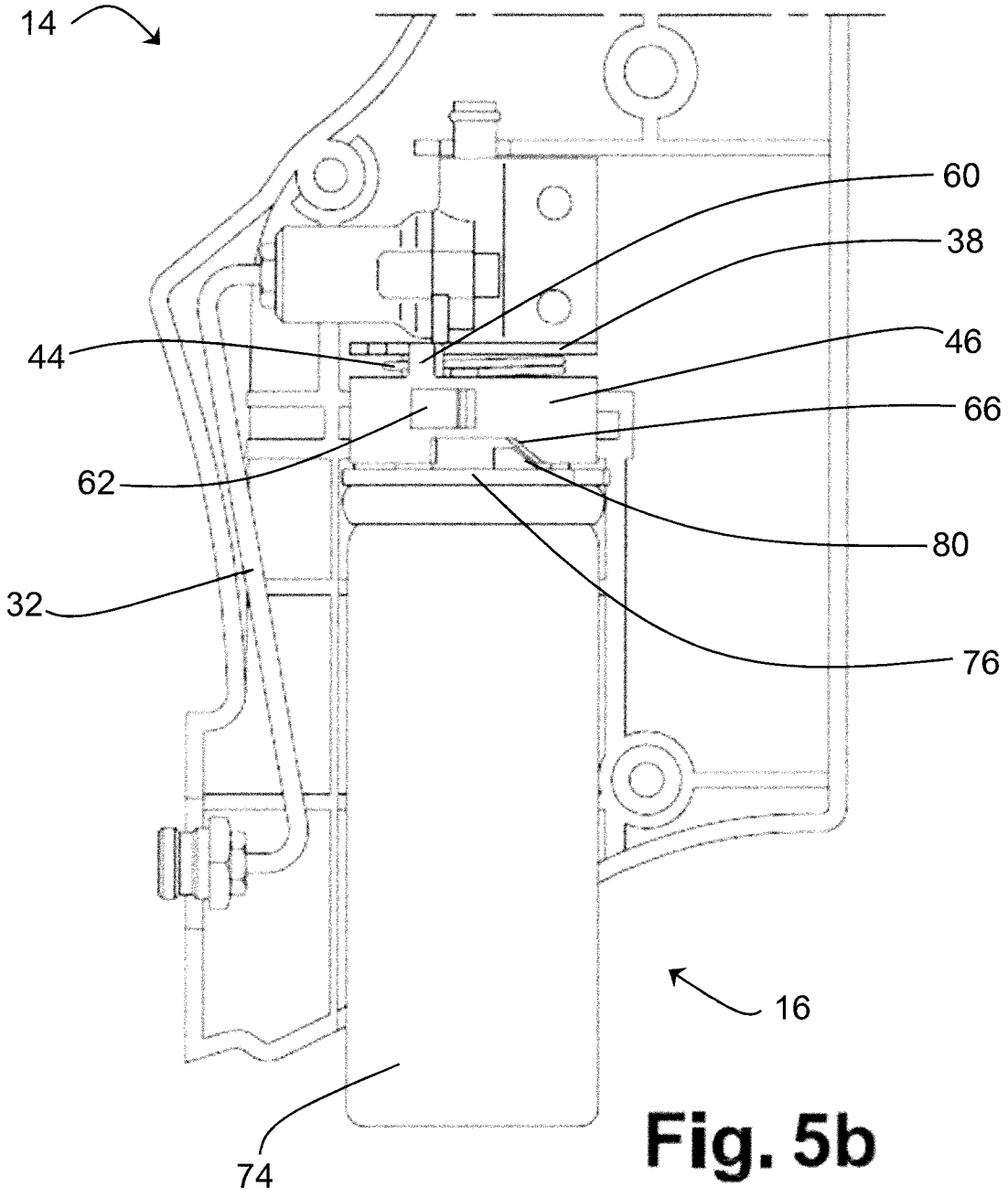

FIG. 5*b* represents the case where the finger 62 has been moved over part of its stroke in the opening of the case, to the point where the cam surfaces 66, 80 are in contact with one another or immediately adjacent to each other. This movement enables the hooks 72, 82 to disengage from each other, thereby unlocking the cartridge 16.

Figure 5C:
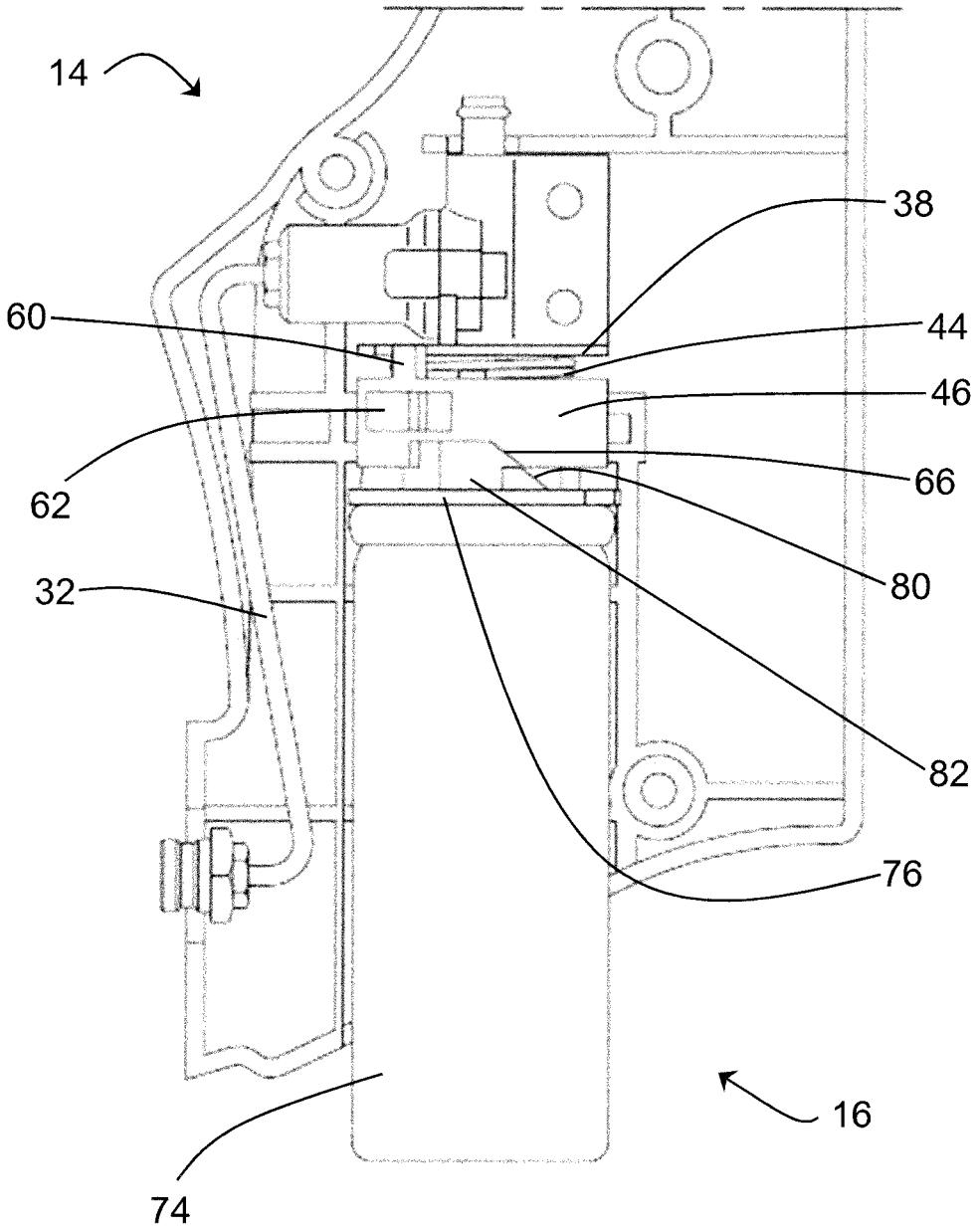

FIG. 5*c* shows the case where the finger 62 is moved further in the opening 64. The cam surfaces 66, 80 cooperate with each other so that the rotation of the ring 46 drives a translational movement of the cartridge 16 along the axis A and the disengagement of the end fittings.

Figure 5D:
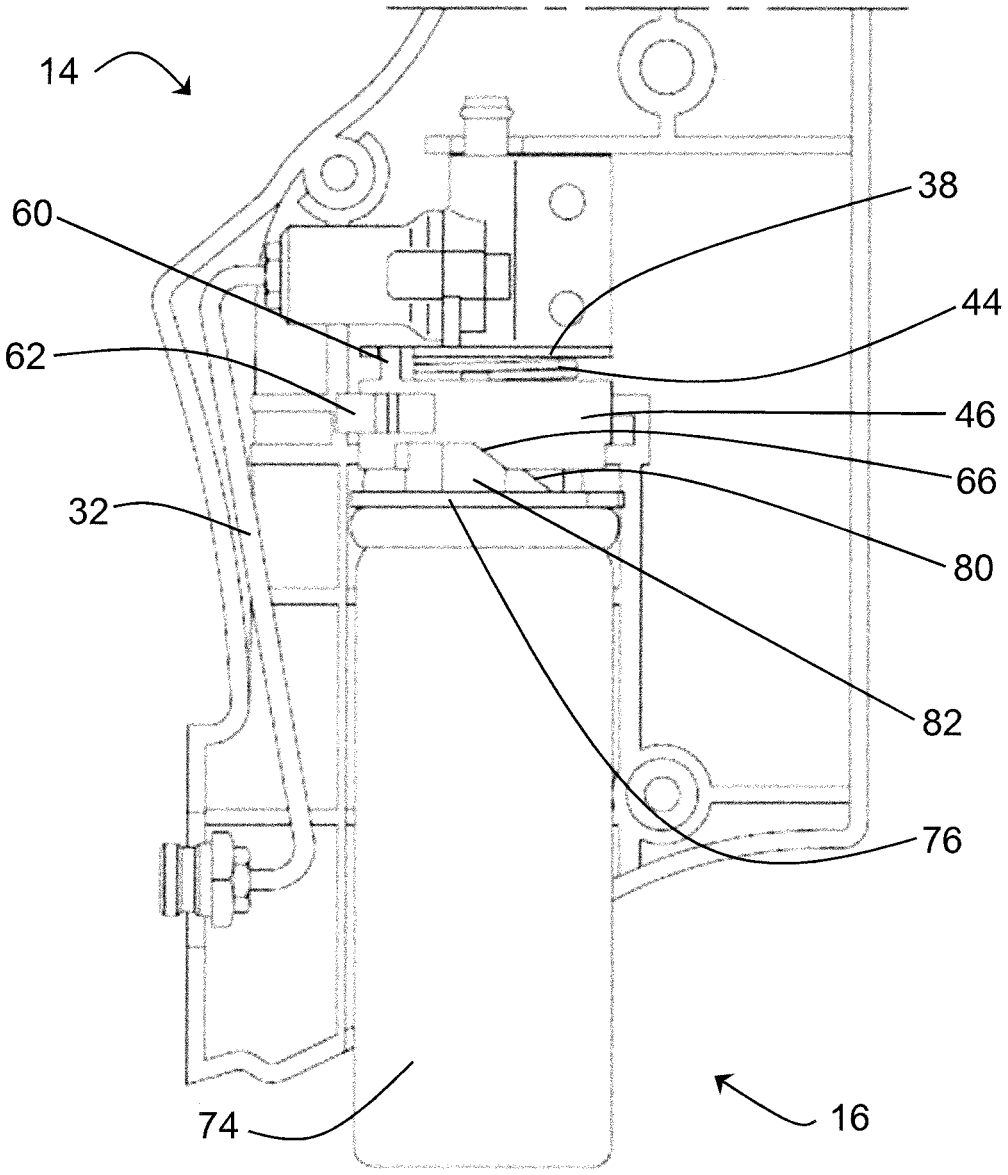

FIG. 5*d* represents the case where the finger 62 has reached the end of its travel in the opening 64. The cam surfaces 66, 80 have finished cooperating together and the end fittings are disengaged from each other.

Figure 5E:
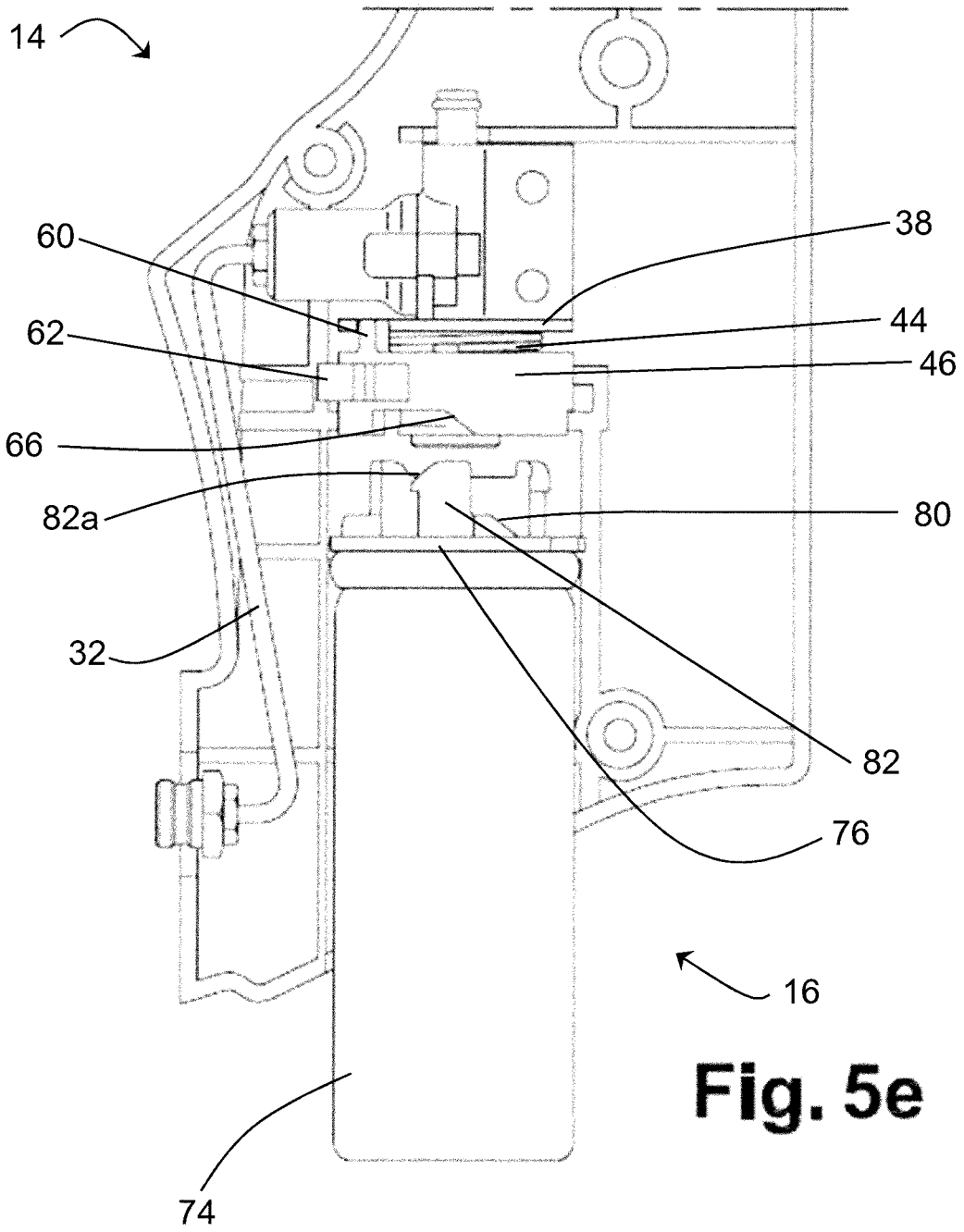

The cartridge 16 can then be manually removed by the user without difficulty, in a translational movement along the axis A (FIG. 5*e*).

In an alternative embodiment of the present disclosure not represented, the ring (mobile) could be borne by the cartridge and the crown ring (fixed) could be borne by the case of the tool.

The invention claimed is:

1. A fuel cartridge for a gas-powered fastener-driving tool, the fuel cartridge comprising:

a body having a top end and a bottom end that defines an internal fuel storage cavity, wherein the top end of the body is configured to be inserted at least partially into and removed from a housing defined by a case of the tool via translation along a longitudinal axis;

a connection and fuel dispensing end fitting connected to the top end of the body and configured to engage an end fitting of the tool within the housing; and a crown ring circumferentially surrounding the top end of the body and extending at least partially around the connection and fuel dispensing end fitting, the crown ring having a stud axially extending from a top surface of the crown ring and a hook axially extending from the top surface of the crown ring, wherein the stud defines a first cam surface extending partially around the longitudinal axis, wherein the hook defines a third cam surface, and wherein the stud and the hook are positioned in an axial and radial misalignment relative to one another on the crown ring.

2. The cartridge of claim 1, wherein the first cam surface is configured to engage with a second cam surface defined by the end fitting of the tool.

3. The cartridge of claim 2, wherein the crown ring comprises multiple first cam surfaces regularly distributed around the longitudinal axis and oriented in the same direction around the longitudinal axis.

4. The cartridge of claim 3, wherein the multiple first cam surfaces are located on a first circumference centered on the longitudinal axis.

5. The cartridge of claim 4, wherein the crown ring comprises multiple hooks sized and shaped to engage a ring of the tool.

6. The cartridge of claim 5, wherein the hooks are located on a second circumference centered on the longitudinal axis, wherein the first and second circumferences are different.

7. The cartridge of claim 1, wherein the crown ring comprises an outer peripheral edge comprising a radially extending tongue.

8. The cartridge of claim 1, wherein the crown ring is formed of a single piece.

9. The cartridge of claim 1, wherein the third cam surface of the hook is configured to engage with a fourth cam surface defined on a ring of the tool.

10. A gas-powered fastener-driving tool comprising:

a case defining a housing having a longitudinal axis, the housing sized and shaped to receive a fuel cartridge; and a second cam surface extending at least partially around the longitudinal axis, the second cam surface configured to engage with a crown ring circumferentially surrounding a top end of the fuel cartridge body, the crown ring having a stud axially extending from a top surface of the crown ring and a hook axially extending from the top surface of the crown ring, wherein the stud defines a first cam surface of the fuel cartridge engagable with the second cam surface when the fuel cartridge is received in the housing, wherein the hook defines a third cam surface of the fuel cartridge, and wherein the stud and the hook are positioned in an axial and radial misalignment relative to one another on the crown ring.

11. The tool of claim 10, which includes a ring rotatable about the longitudinal axis, the ring including the second cam surface.

12. The tool of claim 11, which includes a fuel-injection member including an end fitting sized and shaped to engage an end fitting of the fuel cartridge, wherein the ring is rotatable relative to the fuel-injection member.

13. The tool of claim 11, wherein the ring is rotatable relative to the case and comprises a outer finger extending radially through an opening defined through the case so a free end of the finger is located outside the case.

14. The tool of claim 11, wherein the ring comprises multiple second cam surfaces regularly distributed around the longitudinal axis and oriented in the same direction around the longitudinal axis.

15. The tool of claim 14, wherein the second cam surfaces are located on a first circumference centered on the longitudinal axis.

16. The tool of claim 15, wherein the ring comprises multiple hooks regularly distributed around the longitudinal axis and sized and shaped to engage hooks of the fuel cartridge.

17. The tool of claim 16, wherein the hooks of the ring are located on a second circumference centered on the longitudinal axis, wherein the first and second circumferences are different.

18. The tool of claim 10, wherein the case defines an opening sized to receive a radially extending tongue of the fuel cartridge.

19. The tool of claim 11, wherein the ring comprises a hook defining a fourth cam surface configured to engage the third cam surface of the hook of the fuel cartridge.

* * * * *